US009980362B1

(12) United States Patent
Knausdorf et al.

(10) Patent No.: US 9,980,362 B1
(45) Date of Patent: May 22, 2018

(54) FLEXIBLE PLASMA TREATMENT DEVICE AND METHOD FOR TREATING THE SURFACE OF AN OBJECT WITH THE DEVICE

(71) Applicant: Xerox Corporation, Norwalk, CT (US)

(72) Inventors: Peter J. Knausdorf, Henrietta, NY (US); Mandakini Kanungo, Penfield, NY (US); Jack T. LeStrange, Macedon, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/465,754

(22) Filed: Mar. 22, 2017

(51) Int. Cl.
*H05H 1/24* (2006.01)

(52) U.S. Cl.
CPC ... *H05H 1/2406* (2013.01); *H05H 2001/2412* (2013.01); *H05H 2001/2418* (2013.01)

(58) Field of Classification Search
CPC ..... H05H 1/24; H05H 1/2406; H05H 2001/2412; H05H 2001/2418; H05H 2001/2425; G21K 5/00; G21K 5/02; G21K 5/04; G21K 5/06; G21K 5/08; G21K 5/10
See application file for complete search history.

(56) References Cited

U.S. PATENT DOCUMENTS

| | | | | |
|---|---|---|---|---|
| 9,655,224 | B2 * | 5/2017 | Jung | H05H 1/24 |
| 2012/0271225 | A1 * | 10/2012 | Stieber | A61B 18/042 604/26 |
| 2015/0157870 | A1 * | 6/2015 | Kalghatgi | A61N 1/44 604/23 |
| 2015/0343231 | A1 * | 12/2015 | Sanders | A61N 1/44 607/2 |
| 2016/0271411 | A1 * | 9/2016 | Hummel | A61N 1/44 |

* cited by examiner

*Primary Examiner* — David E Smith
(74) *Attorney, Agent, or Firm* — Maginot Moore & Beck LLP

(57) ABSTRACT

A flexible plasma surface treatment device is configured to conform to an irregular surface of an object to enable treatment of the surface with plasma formed by an electrode in the device. The flexible plasma treatment device includes a layer of flexible dielectric material having an upper surface and a lower surface, a first flexible electrode completely encapsulated within the layer of dielectric material, a second flexible electrode mounted to the lower surface of the layer of dielectric material, and a second layer of flexible electrically insulating material mounted to the lower surface of the layer of flexible dielectric material to expose a first portion of the second electrode and to cover a second portion of the second electrode at the lower surface of the dielectric material layer.

20 Claims, 5 Drawing Sheets

FLEXIBLE PLASMA TREATMENT DEVICE AND METHOD FOR TREATING THE SURFACE OF AN OBJECT WITH THE DEVICE

TECHNICAL FIELD

This disclosure relates generally to surface treatment of objects prior to the surface being printed and, more particularly, to treatment of the object surface with plasma discharge.

BACKGROUND

Printing on plastic or polymer object surfaces and on some metal surfaces with UV curable inks is often a challenge because the ink may not adhere properly to the surface. This lack of adhesion is due to the surface energy of the substrate being too close to the surface tension of the ink with the result that surface wets poorly. Ideally the surface energy of the substrate should be much higher than the surface tension of the ink to enable the ink to wet the surface properly. One method of raising the surface energy of a polymer or metal substrate is to subject the surface to an electrical discharge or plasma, which is known to affect the surface chemically and produce a higher surface energy. Previously known plasma treatment devices, however, tend to be very expensive, may require chambers to maintain specific atmospheric conditions, or are rigid and cannot conform to contoured surfaces for treatment of the surfaces. A plasma surface treatment device that is low cost and flexible and that works in normal atmospheric conditions would be beneficial.

SUMMARY

A low cost, flexible plasma surface treatment device enables polymer and metal surfaces to be treated prior to printing to increase the surface energy substantially. The device includes a layer of flexible dielectric material having an upper surface and a lower surface, a first flexible electrode completely encapsulated within the layer of dielectric material, a second flexible electrode mounted to the lower surface of the layer of dielectric material, and a second layer of flexible electrically insulating material mounted to the lower surface of the layer of flexible dielectric material to expose a first portion of the second electrode and to cover a second portion of the second electrode at the lower surface of the dielectric material layer.

A method of using the low cost, flexible plasma surface treatment device treats polymer and metal surfaces prior to printing to increase the surface energy substantially. The method includes laminating a length of flexible electrical conductive material within a flexible dielectric layer, and bonding a flexible metal foil strip to an outside surface of the flexible dielectric layer to form another electrode at a predetermined distance from the length of electrical conductive material within the flexible dielectric layer.

BRIEF DESCRIPTION OF THE DRAWINGS

The foregoing aspects and other features of a flexible plasma surface treatment device that increases the energy of surfaces before printing are explained in the following description, taken in connection with the accompanying drawings.

DETAILED DESCRIPTION

Figure 1:
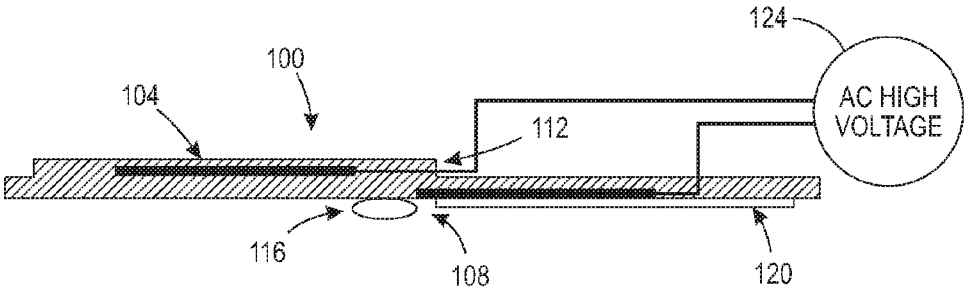
FIG. 1 is a side view of a first embodiment of a flexible plasma surface treatment device.

For a general understanding of the flexible plasma surface treatment device as well as the details for the device, reference is made to the drawings. In the drawings, like reference numerals designate like elements. As used in this document, the term "flexible" means a substrate of material having dimensions that enable the material to form a radius of curvature without breaking or cracking.

FIG. 1 shows a configuration of a flexible plasma surface treatment device. The device 100 has two flexible electrodes 104, 108 that are separated by a flexible dielectric material 112, such as Viton, silicone, rubber, polyimide film or any flexible dielectric material of sufficient dielectric strength to prevent arcing. The first electrode 104 is entirely encapsulated by dielectric material so it is sealed on all of its sides with dielectric material. This encapsulation can be accomplished by placing the electrode into the dielectric at the time the dielectric material is molded or otherwise manufactured, by placing the electrode on the surface of a pre-manufactured dielectric sheet material with Kapton tape, or by flowing a dielectric material over the electrode that is subsequently cured. Encapsulating the electrode 104 eliminates as much air around the electrode as possible so the plasma forms primarily on the second electrode's exposed edge. The second flexible electrode 108 is placed on the opposite side of the dielectric material 112. The edge of the second electrode 108 closest to the first electrode is exposed to ambient air. The exposed edge is the edge from which the plasma 116 forms and radiates in the direction of the encapsulated electrode. The exposed edge of the second electrode 108 is placed in contact with the object being treated. The electrodes are flexible either by their inherent material nature, such as copper foil, or by their manufactured structure, such as a flat braided copper wire made with a fine gauge wire. A flexible electrode can also be made from fine copper wires that run parallel to each other, such as occurs in flexible ribbon cable. A portion of the second electrode 108 can be partially covered by a layer of flexible insulating material 120 to expose a portion of the second electrode 108 and to prevent scratching of the unexposed portion of the second electrode. An alternating current (AC) voltage source or a pulsed DC source 124 is connected to the two electrodes 104, 108 to produce the plasma 116. In one embodiment, the AC source has a frequency of 20 kHZ and produces a voltage of about 12 kilovolts.

Figure 2:
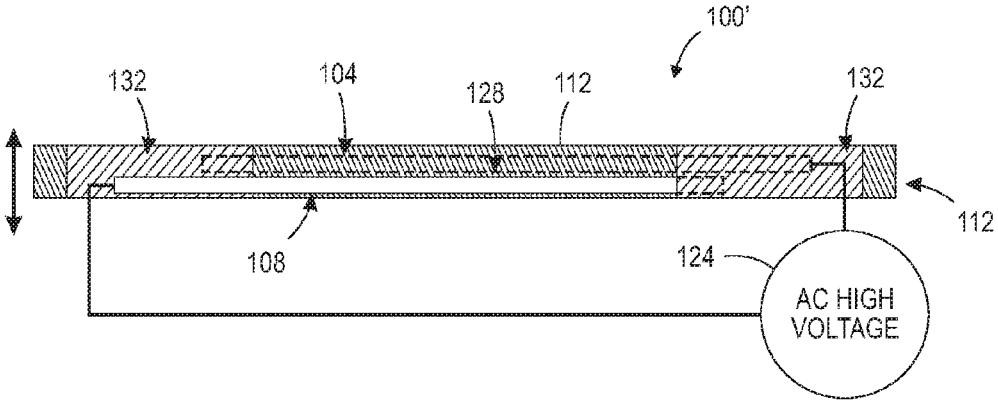
FIG. 2 is a bottom view of an alternative embodiment of the flexible plasma surface treatment device.

A bottom view of an alternative embodiment 100' of the device 100 is shown in FIG. 2. This view reveals that the width of the device is relatively narrow, which aids the flexibility and conformability of the device, especially if the dielectric material 112 is polyimide. The lateral gap 128 between the conductors 104 and 108 shown in the view of FIG. 2 is small and can range in size from none or overlapping to a relatively wide gap of over 5 mm. The width of the gap 128 controls the type of corona that is formed in relation to a given dielectric material 112, with wider gap widths producing a more streaked appearance or filaments and a narrower gap producing a more uniform glow. The materials employed are able to withstand the expected temperatures suitable for the dwell time of the treatment application. The dielectric material 112 encasing electrode 104 and separating electrode 104 from electrode 108 have sufficient dielectric strength that no arcing occurs between the electrodes or their connections to the AC voltage source 124. Additional dielectric material 132 is added at each end of the electrodes to prevent arcing from the corners and ends of the electrodes. The dielectric material must also withstand the heat generated by the plasma during the time of treatment.

Figure 3A:
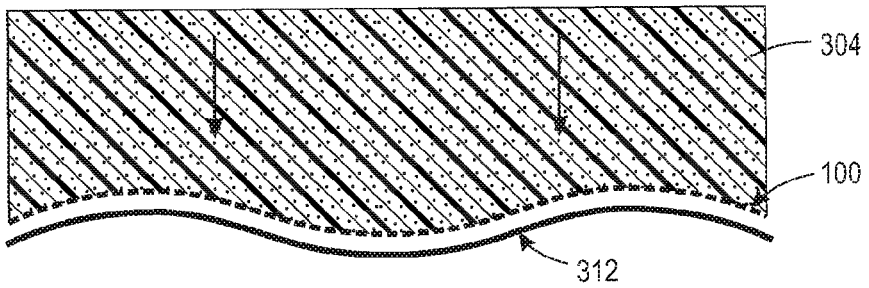
FIG. 3A, FIG. 3B, and FIG. 3C depict alternative embodiments of a mechanism for conforming the flexible plasma surface treatment device of FIG. 1 to the surface of an object.
Figure 3B:
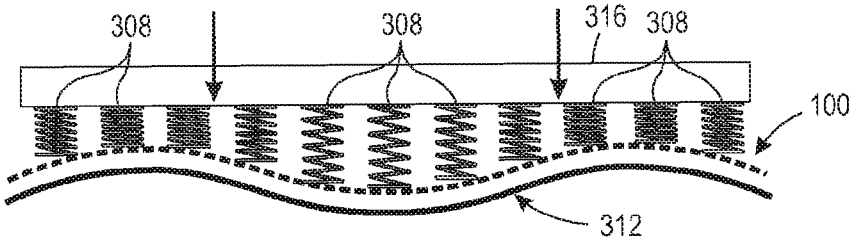
Figure 3C:
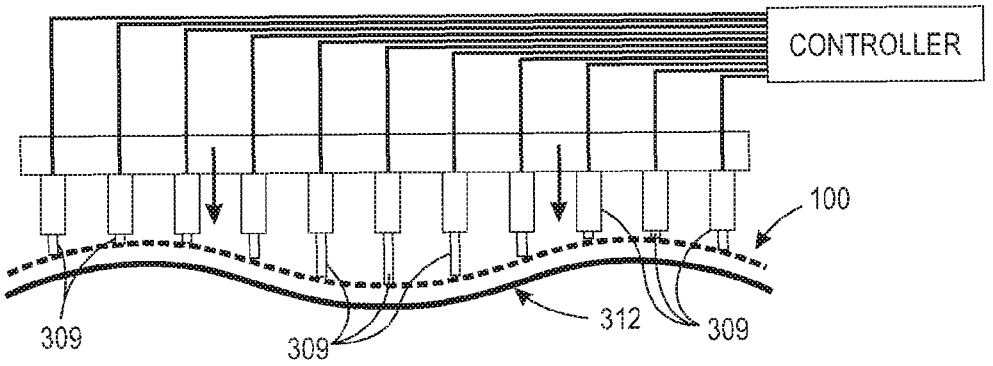

The structure of the devices 100 and 100' that enable the device to achieve the contour of the target object is shown in FIGS. 3A and 3B. In these figures, the device 100 is configured with an articulated pressure mechanism. Articulation is achieved through a force foam 304 (FIG. 3A) or by biasing members 308 (FIG. 3B) having a low spring rate so the device 100 can conform to the surface of the object 312 being treated. As used in this document, "low spring rate" means a rate of not more than 0.035 kg/cm$^2$. Alternatively, actuators 350 can replace the biasing members 308 as shown in FIG. 3C. The actuators 350 can be driven to a preset position and left there when they conform to the shape of the object being treated or they could be actively articulated by a controller 354 operatively connected to the actuators 350 to enable the actuators to move with reference to a contour scan of the object's surface. The actuators can be a screw driven by a motor operatively connected to the controller or they can be pressure transducers that adjust in length in response to the pressure applied by the surface of the object 312 as the support member 316 to which the transducers are mounted are urged against the surface of the object. This description also applies to the embodiment 100'.

Figure 4:
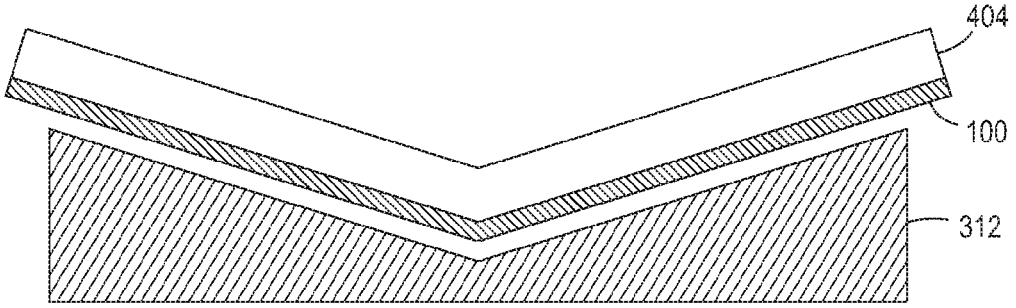
FIG. 4 illustrates a sharp bend in an object that is being treated with a pre-formed flexible plasma surface treatment device.

Rather than using the structures that conform the device 100 or 100' to the surface of an object 312 noted above, a structure 404 complementary to the exterior of the object can be made and the device 100 or 100' mounted to the structure 404 as shown in FIG. 4. The device can then be scanned over the object or the object can be passed under the device. Such a pre-formed structure is particularly useful where the contours of the object are too great to achieve conformance of the device to the object surface through pressure alone as shown in FIG. 4. Such a situation occurs when the object surface has sharp angles and a pressure compliance scheme would tend to form the device with a radius rather than the sharp angle of the surface.

Figure 5:
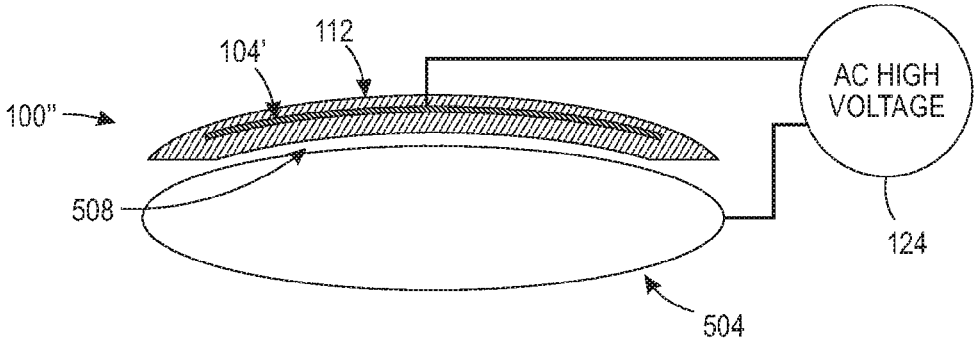
FIG. 5 is a depiction of an alternative embodiment of a flexible plasma surface treatment device useful for treating the surface of a metal object.
Figure 6:
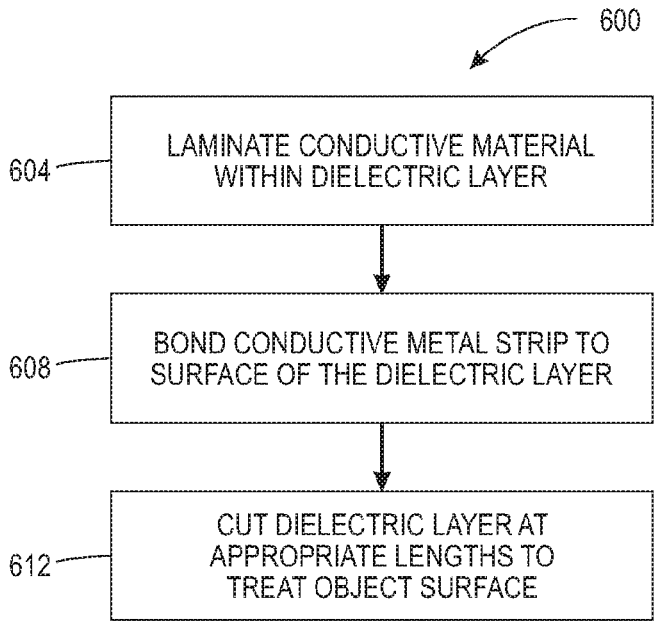
FIG. 6 depicts a process for forming a roll of flexible plasma surface treatment devices.

By changing the configuration of both the electrodes and dielectric, the device 100 or 100' can also treat metal with plasma. If the device is unchanged from the configurations discussed above, metal objects cause arcing when they touch or are brought too close to electrode 108. This arcing arises because metal is an electrical conductor and it alters the gap between electrode 104 and electrode 108. Thus, a high potential gradient is produced that leads to arcing. To address this issue, one of the electrodes is disconnected from the AC voltage source 124 to enable the metal object to operate as the second electrode. A simple way of achieving this goal is to flip the device over, disconnect electrode 108 from the AC voltage source 124 and connect the AC voltage source 124 to the metal object. This method presumes that the encapsulating dielectric material 112 around electrode 104 that now is adjacent the metal object has sufficient dielectric strength. An alternative approach is to disconnect electrode 104 from the AC voltage source 124 and electrically connect it to the metal object. A dielectric material is then placed between electrode 108 and the metal object. This configuration can be accomplished by placing a sheet of dielectric material, such as Viton, over the metal object. In an alternative embodiment of the device 100, a device 100" (FIG. 5) can be configured by encapsulating a single electrode 104' in dielectric material 112. The electrode 104' and the metal object 504 are then connected to the AC voltage source 124 as shown in FIG. 5 to produce plasma in gap 508. In these configurations used with metal objects, the plasma treatment device or object are move relative to one other as described above with regard to the non-metallic objects.

The flexible nature of the devices described above make the manufacture of rolls of devices possible so the devices can be installed or replaced as needed. The rolls of devices can be made in both the non-metallic or metallic configurations and cut from the roll as needed. One method 600 of manufacturing such a roll is to laminate a length of electrically conductive material within a polyimide layer (block 604) and bond a metal foil strip to the outside surface of the layer (block 608). The length of the electrically conductive material corresponds to the length of the dielectric layer and similarly, the metal foil strip has a length that corresponds to the length of the dielectric layer. The dielectric layer is cut at lengths appropriate for treating an object surface (block 612). By keeping the electrodes and the gap between them as narrow as possible the device can be made very narrow, which allows it to flex more readily along its longitudinal axis. The resulting device can be used for either metal or non-metallic objects depending on which side was placed adjacent to the object and which electrodes or electrode were connected to the AC voltage source as described previously.

Figure 7:
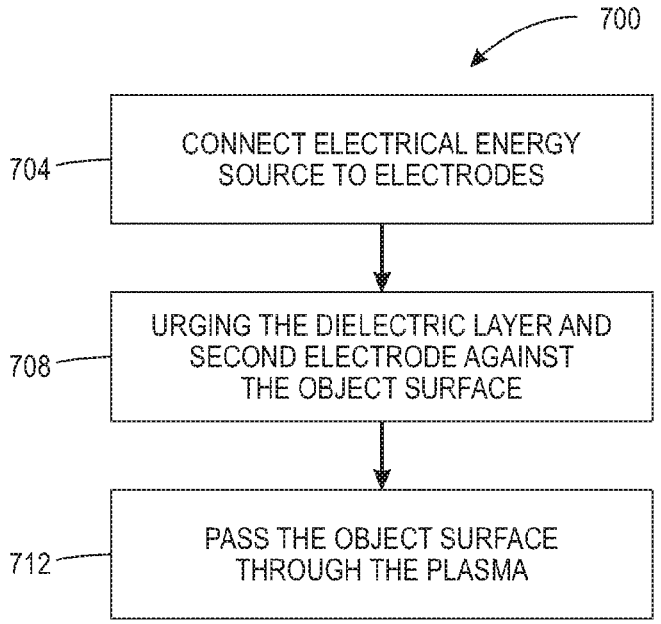
FIG. 7 depicts a process for using the flexible plasma surface treatment device to treat the surface of an object.

A method for using any of the embodiments of the flexible plasma treatment device described above is shown in FIG. 7. Electrodes 104 and 108 are attached to a high voltage, high frequency, AC voltage source or pulsed DC current source (block 704). The dielectric layer is urged against the surface of the object being treated by one of the pressure mechanisms described above (block 708) and the object is passed through the plasma for treatment of the surface (block 712). The source identified above produced a plasma of ~12 mm in width and 125 mm in length. The plasma can also be shaped so it has an arch. This arch is accomplished by arching the dielectric material in the area of the gap positioned between the electrodes. This arching enables the plasma to be more exposed and easier to place in contact with the surface being treated. Using the methods described above, a round or oval shaped device can be produced that generates an arched plasma.

Figure 8:
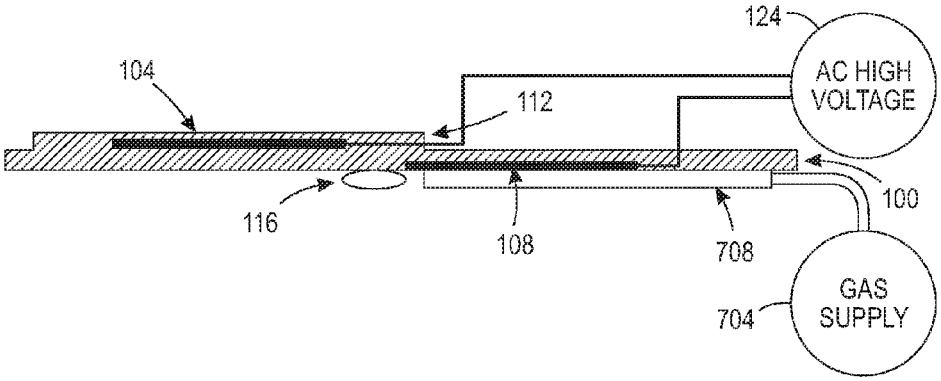
FIG. 8 is a side view of a flexible plasma surface treatment device configured with a gas supply to alter the plasma treatment of an object surface.

To further enhance the effectiveness of the flexible plasma treatment devices described above, it can be used with a gas source, such as oxygen, argon, nitrogen, hydrogen, or helium to alter the treatment of a substrate. Such an embodiment is shown in FIG. 8 where device 100 includes electrodes 104 and 108 within dielectric material 112 and the electrodes are connected to the electrical source 124. A gas supply 704 is coupled to a conduit 708 to deliver gas at the plasma site 116 to alter the treatment of the object surface. The conduit 708 delivers the gas or a mixture of one or more of the above-identified gases in the direction of the plasma flow as shown in the figure by the arrow. A specific gas or mixture of gasses can be employed to produce the desired effect.

Constructing a flexible plasma surface treatment device as described above enables the device to conform to the surface of the object being treated. The device maintains a uniform plasma sheet as alternating current is applied to the two electrodes in the device, even while the device conforms to the surface of the item being treated. Additionally, the device is constructed from materials that are able to withstand the heat generated by the plasma and the reactive nature of the plasma treatment process. The device, depending on its configuration, produces plasma that is ~12 mm wide and that spans the entire length of the electrodes. In use the device is placed in contact with the surface being treated and either the device is moved or the surface being treated is moved perpendicular to the longitudinal axis of the device so the entire area needing treatment is treated. The treatable area depends on the width of the device and the distance the device is moved in relation to the object surface. The element can either be pre-formed to the object being treated or pushed into the object to conform to the object surface by a biasing member, foam backing, or actuator.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A flexible plasma treatment device comprising:

a layer of flexible dielectric material having an upper surface and a lower surface;

a first flexible electrode completely encapsulated within the layer of dielectric material;

a second flexible electrode mounted to the lower surface of the layer of dielectric material; and a second layer of flexible electrically insulating material mounted to the lower surface of the layer of flexible dielectric material to expose a first portion of the second electrode and to cover a second portion of the second electrode at the lower surface of the dielectric material layer.

2. The flexible plasma treatment device of claim 1 wherein the flexible dielectric material is polyimide, silicone, rubber, or Viton.

3. The flexible plasma treatment device of claim 1 wherein the flexible first electrode and the flexible second electrode consist essentially of copper foil.

4. The flexible plasma treatment device of claim 1 wherein the flexible first electrode and the flexible second electrode consist essentially of braided copper wire.

5. The flexible plasma treatment device of claim 1 further comprising:

an alternating current (AC) voltage source electrically connected to the first flexible electrode and the second flexible electrode.

6. The flexible plasma treatment device of claim 5 wherein the AC voltage source outputs an electrical voltage at a frequency of about 20 kHz and a magnitude of about 20 kV.

7. The flexible plasma treatment device of claim 1 further comprising:

a pulsed direct current (DC) source electrically connected to the first flexible electrode and the second flexible electrode.

8. The flexible plasma treatment device of claim 1 wherein the device is formed with a predetermined shape that is complementary to a shape of a surface of an object to be treated.

9. The flexible plasma treatment device of claim 1 further comprising:

a pressure mechanism mounted to the upper surface of the flexible dielectric material to urge the flexible plasma treatment device against a surface of an object to be treated.

10. The flexible plasma treatment device of claim 9 wherein the pressure mechanism is a layer of foam material having a low spring rate.

11. The flexible plasma treatment device of claim 9, the pressure mechanism further comprising:

a plurality of biasing members, each biasing member having a first end and a second end, the first end of each biasing member being operatively connected to a member and the second end of each biasing member being operatively connected to the upper surface of the flexible dielectric layer.

12. The flexible plasma treatment device of claim 11 wherein each biasing member is a spring.

13. The flexible plasma treatment device of claim 11 wherein each biasing member is an actuator.

14. The flexible plasma treatment device of claim 1 further comprising:

a source of gas configured to direct gas towards the exposed portion of the second flexible electrode.

15. The flexible plasma treatment device of claim 14 wherein the source of gas is a source of oxygen, argon, nitrogen, hydrogen, helium or a mixture of one or more of these gases.

16. A method for manufacturing a roll of flexible plasma treatment devices comprising:

laminating a length of flexible electrical conductive material within a flexible dielectric layer; and bonding a flexible metal foil strip to an outside surface of the flexible dielectric layer to form another electrode at a predetermined distance from the length of electrical conductive material within the flexible dielectric layer.

17. The method of claim 16 wherein the length of flexible electrical material is a copper strip having a length that corresponds to a length of the flexible dielectric layer.

18. The method of claim 17 wherein the flexible metal foil strip is a copper foil strip having a length that corresponds to the length of the flexible dielectric layer.

19. A method of treating a surface of an object comprising:

electrically connecting a first flexible electrode encapsulated with a layer of flexible dielectric material and a second flexible electrode mounted to a surface of the layer of flexible dielectric material to a high voltage, high frequency, AC voltage source to generate a plasma at an exposed portion of the second flexible electrode;

urging the dielectric layer against a surface of an object; and passing the surface of an object through the plasma to increase a surface energy of the surface of the object.

20. The method of claim 19 further comprising:

arching the layer of flexible dielectric material in an area of a gap positioned between the first flexible electrode and the second flexible electrode.

* * * * *